United States Patent [19]

Cruchon et al.

[11] Patent Number: 4,849,722

[45] Date of Patent: Jul. 18, 1989

[54] ADJUSTABLE BAND SUSPENDED SUBSTRATE FILTER

[75] Inventors: Jean-Claude Cruchon, Bouffemont; Jean-Denis Schubert, Verneuil sur Seine, both of France

[73] Assignee: Alcatel Thomson Faisceaux Hertziens, Levallois Perret Cedex, France

[21] Appl. No.: 101,033

[22] Filed: Sep. 25, 1987

[30] Foreign Application Priority Data

Sep. 25, 1986 [FR] France ..... 86 13405

[51] Int. Cl.[4] ..... H01P 1/203

[52] U.S. Cl. ..... 333/205; 333/246

[58] Field of Search ..... 333/204, 205, 210, 211, 333/219, 246

[56] References Cited

U.S. PATENT DOCUMENTS

| | | | |
|---|---|---|---|
| 2,820,201 | 1/1958 | Tomigasa | 333/256 X |
| 2,968,012 | 1/1961 | Alstadter | 333/205 |
| 3,117,379 | 1/1964 | Ayer | 333/246 X |
| 3,754,198 | 8/1973 | Anghel | 333/204 |
| 3,863,181 | 1/1975 | Glance et al. | 333/246 X |
| 3,882,396 | 6/1975 | Schneider | 455/325 |
| 4,028,650 | 6/1977 | Konishi et al. | 333/208 |
| 4,276,655 | 6/1981 | Kraemer et al. | 333/246 X |
| 4,365,195 | 12/1982 | Stegens | 333/246 X |
| 4,443,314 | 2/1984 | Hislop et al. | 333/204 X |

OTHER PUBLICATIONS

Rooney, J. P. et al.; "Printed Circuit Integration of MW Filters" *Microwave Journal;* vol. 21, No. 9, Sep. 1978; pp. 68–73.

*Primary Examiner*—Eugene R. LaRoche
*Assistant Examiner*—Benny T. Lee
*Attorney, Agent, or Firm*—Sughrue, Mion, Zinn, Macpeak, and Seas

[57] ABSTRACT

An adjustable band filter comprising a conductive screening body (10, 11) made of two parts (10 and 11) joined to each other on either side of a separation plane (13), a cavity (12) inside said body, said cavity containing a half wavelength resonant line (15) carried on a first face (16) of a suspended substrate (14), the substrate being end-coupled and received in grooves (17) made in the walls of the first portion (10). The first face (16) of the substrate (14) divides the cavity (12) into two asymmetrical volumes in such a manner as to enable the passband of said filter to be modified.

10 Claims, 4 Drawing Sheets

ADJUSTABLE BAND SUSPENDED SUBSTRATE FILTER

The invention relates to an adjustable band filter for use at high frequencies.

BACKGROUND OF THE INVENTION

The following filters are known:

filters having circular or rectangular (waveguide) cavities and a high Q factor, e.g. greater than 3000;

cylindrical or rectangular coaxial filters of the end coupling type (of wavelength $\leqq\lambda/2$; where $\lambda$ is the wavelength of the guided wave) or of the coupled line type (wavelength $\leqq\lambda/4$) having a Q factor of not more than 1000;

microstrip filters on dielectric substrates but having very low Q, below 200, together with non-negligible insertion losses; and dielectric resonator filters having an intermediate Q lying between 100 and 3000.

However, implementation of such filters at high frequencies remains both difficult and expensive.

Another possibility currently in use consists in using end coupled $\lambda/2$ resonant linesmounted on a suspended substrate.

An article entitled "Design and performance of millimeter wave end coupled bandpass filters" published in "International Journal of Infrared and Millimeter Waves" (Volume 6 No. 7 1985) describes filters of this type in which the resonant lines are formed by sequences of periodic discontinuities situated along transmission lines in order to form series of resonators which are coupled to one another.

The invention seeks to provide an apparatus having the advantages of this type of filter, namely:

good reproducibility due to the fact that a chemical photo etching technique is used;

low cost due to the simplicity of the circuit; and no adjustment necessary for using the filter.

However, the invention also makes it possible to modify the passband and it makes it possible to integrate a stop band function which allows absorption or rejection of waves.

An apparatus in accordance with the invention is capable of operating in a frequency range running from 1 GHz to 100 GHz.

SUMMARY OF THE INVENTION

To this end, the present invention provides an adjustable band filter comprising a conductive screening body made of two parts joined to each other on either side of a separation plane and defining a cavity inside said body, said cavity containing a half wavelength resonant line made if resonators coupled to one another in series by their ends and carried on a first face of a suspended substrate, the substrate being end-coupled and received in grooves made in the walls of one of the two portions, the filter being characterized in that the first face of the substrate divides the cavity into two asymmetrical volumes in accordance with the desired passband of said filter, and in that the substrate is situated in the first portion of the screening body and has its first face situated in the separation plane.

Such a filter has the advantage of using a simple technique enabling it to be adjusted without using a metal or dielectric screw.

In addition, the invention makes it possible to provide filters whose passbands lie between several percent to several tens of percent of 11 GHz to 15 GHz whereas the principle of end-coupled filters is restricted to a band of a few percent.

In a first type of embodiment, the invention provides a filter in which the first face of a substrate is situated in the separation plane and in which the volume of the cavity situated within the second portiion is greater than its volume situated within the first portion.

In another type of embodiment, the invention provides a filter in which the first portion is offset relative to the second portion in a transverse direction along the separation plane, thereby creating a dicontinuity in the walls of the cavity in said plane.

Advantageously, the invention provides a filter in which both portions of the screening body have transverse notches machined in those of their walls which are in contact.

Advantageously, in order to make an adjustable filter in accordance with the invention, the second portion of the screening body constitutes a sheath in which the first portion may slide so as to modify the position of the substrate inside the cavity.

BRIEF DESCRIPTION OF THE DRAWINGS

Preferred embodiments of the invention are described by way of example with reference to the accompanying drawings, in which.

DESCRIPTION OF PREFERRED EMBODIMENTS

Figure 1:
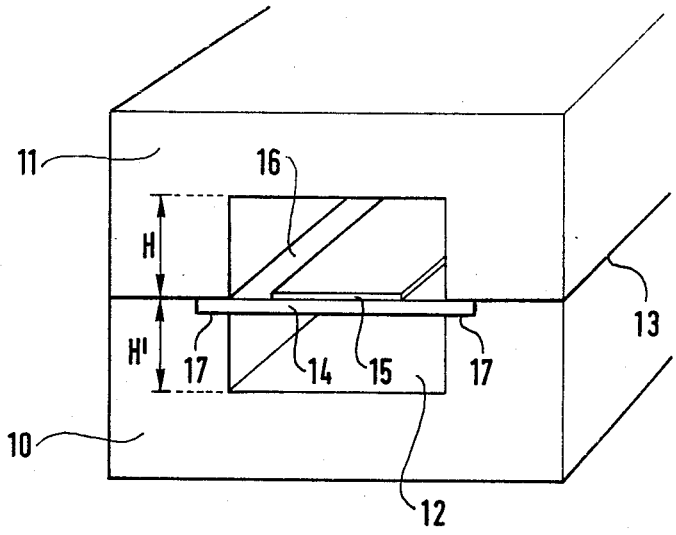
FIG. 1 shows a filter in accordance with the invention.

The filter in accordance with the invention shown in FIG. 1 comprises a screening body 10, 11 in the form of a rectangular parallelipiped having a cavity 12 of the same shape situated therein.

The screening body comprises a first portion 10 and a second portion 11 situated on either side of a "separation" plane 13.

A substrate 14 carrying a half wavelength resonant line 15 on a first face 16 thereof is received in two grooves 17 made in said first portion 10 in such a manner that its first face 16 lies in the separation plane 13.

Figure 2:
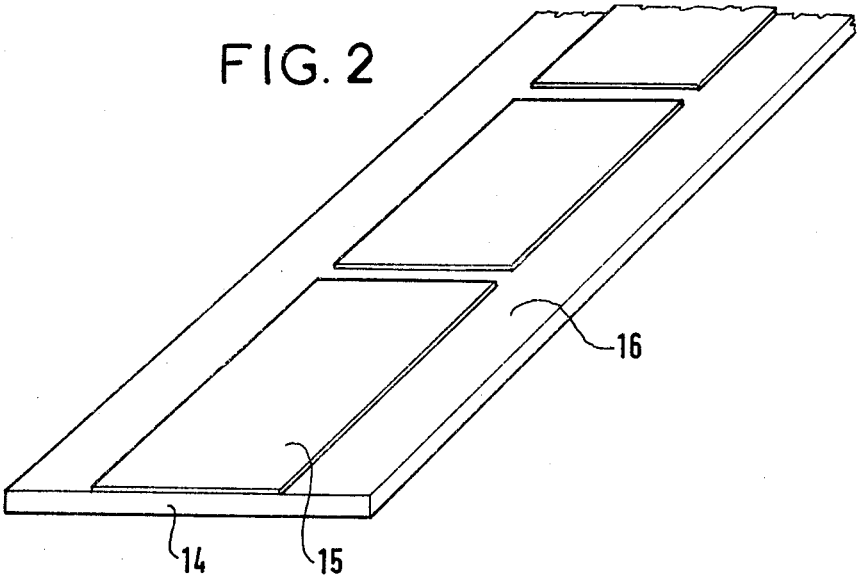
FIG. 2 shows a portion of the FIG. 1 filter.

As shown in FIG. 2, this line may, for example, be a line of the microstrip type comprising resonators in series coupled by their ends (serial capacitive coupling). These resonators are not greater than $\lambda/2$ in length and may be approximately equal to $k\cdot\lambda/2$, where k is a constant and $\lambda$ is the wavelength of the guided wave.

With this type of filter, line excitation takes place "end-on" and is longitudinal excitation.

In accordance with the invention, in order to obtain passband adjustment, asymmetry proportional to the height of the dielectric is provided in the top portion: i.e. $H>H'$, where H is the height of the top portion and $H'$ is the height of the bottom portion.

In order to balance the electromagnetic fields, standard practice would require $H<H'$.

Figure 3:
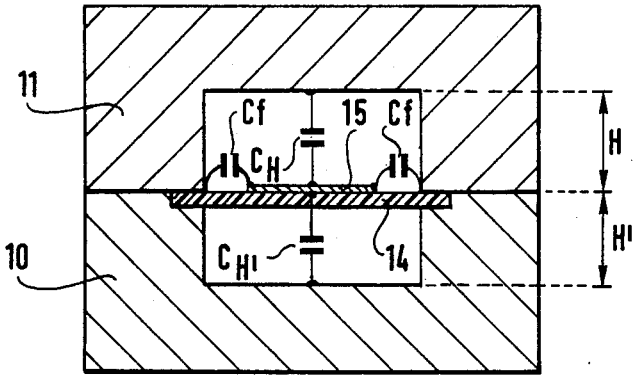
FIGS. 3 and 4 are a cross-section and a longitudinal section through a filter in accordance with the invention with various electrostatic capacitances being marked thereon.
Figure 4:
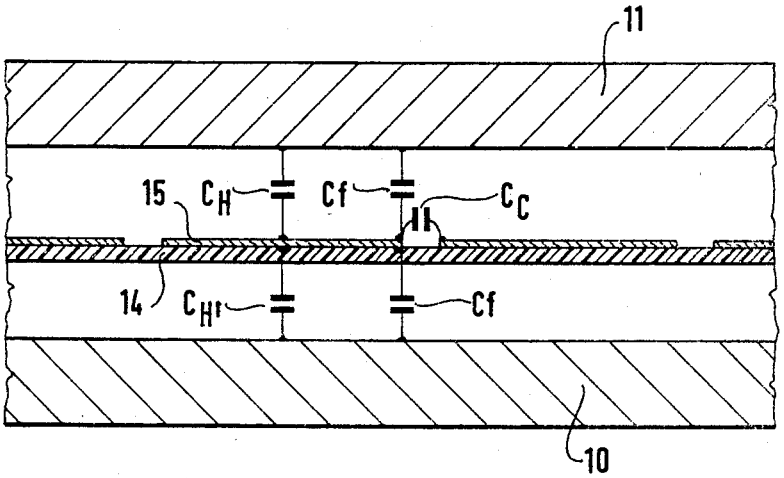

It may be observed that, for the facing portions of metallization, the distribution of capacitance in the line is asymmetrical from the electrostatic point of view, as shown in FIGS. 3 and 4:

Cf leakage and angle capacitance;

CH' housing/line capacitance (bottom half); and

CH housing/line capacitance (top half).

Thus, it is possible in accordance with the invention to make use of the asymmetry to act on the passband of the filter by altering the distribution of its capacitances, thereby widening the passband while retaining good matching and limiting losses to a minimum.

A resonator is defined by its impedance and by its coupling to other lines using the formula:

$$\theta j = \pi - \frac{1}{2}\left[\arctan\left(\frac{2Bj-1,j}{yo}\right) + \arctan\left(\frac{2Bj,j+1}{yo}\right)\right]$$

where:

$\theta$j = electric length of the resonator;

Bj,j+1 = susceptance of the capacitance Cc; and yo = line impedance

As a result, changing H causes both CH and Cf to vary, thereby varying yo. There is thus an increase in the coupling capacitance Cc proportional to (Bj,j+1)/yo.

Figure 5:
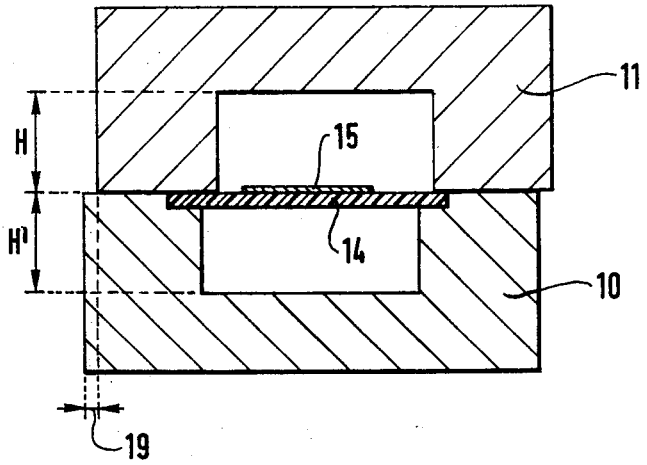
FIGS. 5 to 8 show several variant filters in accordance with the invention.

In one variant of the invention as shown in FIG. 5, asymmetry is provided by shifting the first portion 10 relative to the second portion 11 in a transverse direction along the separation plane 13 as shown at spacing (19), however in this case it is possible to have H≧H'.

Figure 6:
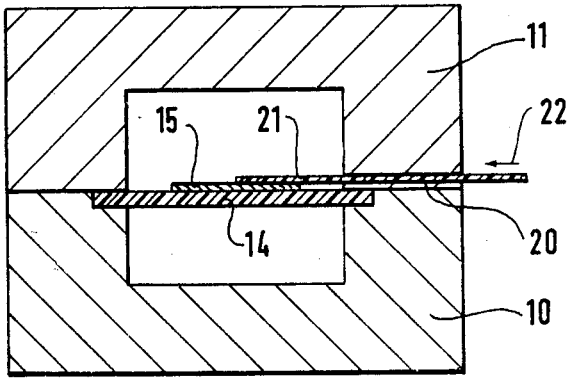

In order to improve matching to the line 15, a dielectric tongue 21 may be inserted, as shown in FIG. 6, through a small slot 20 provided in the second portion 11 of the screening body in a direction shown by arrow (22), said tongue lying over the line 15 so as to improve coupling, in particular at the ends thereof.

Similarly, a vertical metal or dielectric screw disposed in an opening over the circuit 15 could be used such that adjusting the height of its end serves to improve such coupling.

Figure 7:
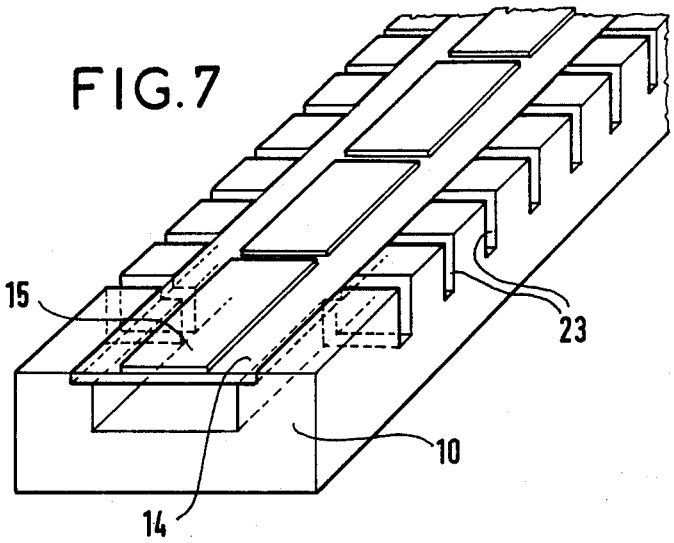

As shown in FIG. 7, it is also possible, by virtue of the radial distribution of the electric field, to associate a band stop function with a filter in accordance with the invention by adding waveguide means along at least one of the sides of the screening body. In FIG. 7, waveguide means are added in the form of transverse notches 23 which are machined through the contacting walls of the two portions 10 and 11 of the screening body. If these notches are closed they constitute rejection stop bands; whereas if they are partially filled with absorbent material they act as absorption stop bands.

The notches 23 have been shown only for the first portion of the screening body 10, however they are similarly disposed for the second portion 11.

It is equally possible to provide such notches in the wall of the second portion 11 facing the substrate 14.

The notches 23 may be uniformly spaced or otherwise.

Such band stop filtering makes it possible to obtain specific rejection, in particular for attenuating certain harmonics.

Figure 8:
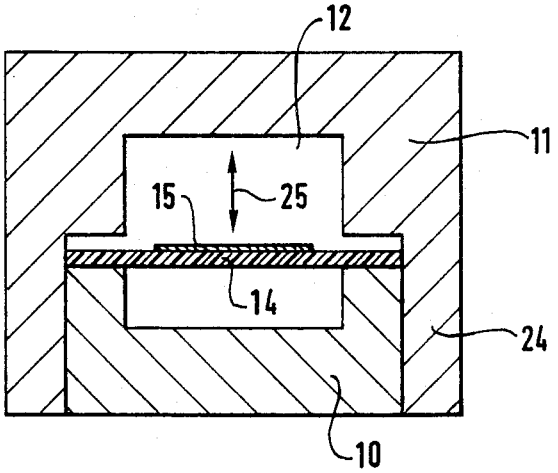

FIG. 8 shows a housing for an adjustable band filter in which the second portion 11 includes a sheath 24 surrounding the first portion 10, thereby enabling the dimensions of the cavity 12 to be modified in the direction shown by arrows 25, thereby modifying the ratio of the dimension H relative to the dimension H' as shown in FIG. 1.

By way of non-limiting example, a filter as shown in FIG. 1 has been made with the following dimensions, assuming the body to be disposed vertically:

cavity length 5.6 cm cavity height (H+H') 2.85 cm dielectric thickness 0.254 cm thickness of metallization 17 μm width of grooves (17) 0.5 cm This provides a filter centered on 15 GHz with a passband of 2.7 GHz.

In order to improve operation, the screening body has very low surface roughness.

Naturally the present invention has been described and shown purely by way of preferred example and its component parts could be replaced by equivalent parts without thereby going beyond the scope of the invention.

For example, metallization could be provided on both sides of the substrate.

Similarly, the body could have a shape other than that of a rectangular parallelipiped.

We claim:

1. An adjustable band filter comprising a conductive screening body made of two portions joined to each other at a separation plane and movable with respect to one another, said body defining an inside cavity, said cavity containing a suspended substrate, a plurality of resonators, each resonator having opposite ends and said resonators being coupled to one another in series by said ends and said resonators being carried on a first face of said suspended substrate, the substrate being received in grooves made in the walls of one of the two portions, wherein the first face of the substrate divides the cavity into two asymmetrical volumes in accordance with a desired passband of said filter, and wherein the substrate is situated in a first portion of the screening body and has its first face situated in the separation plane.

2. A filter according to claim 1, wherein the volume of the cavity which is adjacent to the first face of the substrate is greater than the other volume thereof.

3. A filter according to claim 1, wherein signals are coupled to and from said filter at first and second ends of said substrate, said substrate first and second ends being displaced with respect to one another along a longitudinal direction of said substrate, and wherein the first portion is slidable relative to a second portion of the screening body in a direction transverse to said longitudinal direction along the separation plane, thereby creating a discontinuity in the walls of the cavity in said plane.

4. A filter according to claim 1, wherein the cavity is in the form of a rectangular parallelipiped, with the separation plane splitting it into two volumes of the same shape.

5. A filter according to claim 1, wherein a second portion of the screening body includes a slot through which a dielectric tongue slides, the tongue thereby taking up a position in the vicinity of the first face of the substrate in order to improve coupling.

6. A filter according to claim 1, wherein a second portion of the screening body forms a sheath in which the first portion may slide so as to modify the position of the substrate within the cavity.

7. A filter according to claim 6, wherein said first portion is slidable toward and away from said second portion.

8. An adjustable band filter comprising a conductive screening body made of two portions joined to each other at a separation plane, said body defining an inside cavity, said cavity containing a suspended substrate, a plurality of resonators, each resonator having opposite ends and said resonators being coupled to one another in series by said ends and carried ona first face of said suspended substrate, the substrate being received in grooves made in the walls of one of the two portions, signals being coupled to and from said filter at first and second ends of said substrate, said first and second ends being displaced with respect to one another along a longitudinal direction of said substrate, wherein the first face of the substrate divides the cavity into two asymmetrical volumes in accordance with a desired passband of said filter, and wherein the substrate is situated in a first portion of the screening body and has its first face situated in the separation plane, and wherein notches transverse to said longitudinal direction are machined in those walls of the two portions of the screening boyd which are in contact with one another.

9. A filter according to claim 8, wherein said notches are uniformly distributed in the longitudinal direction.

10. A filter according to claim 8, wherein said notches are partially filled with an absorbent material.

* * * * *